United States Patent [19]

Hartrum

[11] Patent Number: 4,732,434

[45] Date of Patent: Mar. 22, 1988

[54] HORIZONTAL FILE DRAWER INTERLOCK ASSEMBLY

[75] Inventor: Laude E. Hartrum, Pentwater, Mich.

[73] Assignee: Metalworks, Inc., Ludington, Mich.

[21] Appl. No.: 912,543

[22] Filed: Sep. 29, 1986

[51] Int. Cl.[4] ..... E05C 7/06

[52] U.S. Cl. ..... 312/221; 312/217

[58] Field of Search ..... 312/107.5, 216, 217, 312/218, 219, 220, 221, 310

[56] References Cited

U.S. PATENT DOCUMENTS

| | | | |
|---|---|---|---|
| 3,909,090 | 9/1975 | Breckner et al. | 312/217 |
| 4,298,236 | 11/1981 | Laroche | 312/221 |
| 4,355,851 | 10/1982 | Slusser | 312/221 |
| 4,480,883 | 11/1984 | Young | 312/220 |

FOREIGN PATENT DOCUMENTS

| | | | |
|---|---|---|---|
| 1153655 | 8/1963 | Fed. Rep. of Germany | 312/221 |
| 561249 | 9/1983 | Fed. Rep. of Germany | 312/218 |
| 3431386 | 3/1986 | Fed. Rep. of Germany | 312/221 |

*Primary Examiner*—Kenneth J. Dorner
*Assistant Examiner*—Gerald A. Anderson
*Attorney, Agent, or Firm*—Ian C. McLeod

[57] ABSTRACT

An interlock assembly (20) for two or more horizontally sliding drawers (11, 12) in a cabinet (10) to prevent opening more than one drawer at a time is described. The interlock assembly is characterized by each drawer having rotating cam members (22, 23) with lobes (23*a* and 23*b*) and valleys (23*c* and 23*d*) which mate with corresponding lobes (26*a*, 27*a*) and valleys (26*c*, 27*c*) in blocks (26 and 27). When the cam member (23) is rotated the lobes (23*a*, 23*b*) and (23*c* and 23*d*) engage lobes (26*a* and 27*a*) of the blocks (26 and 27) to move the blocks and cam members as a train so as to engage the cabinet (10) to provide the interlock of the drawers.

24 Claims, 8 Drawing Figures

Figure 2:
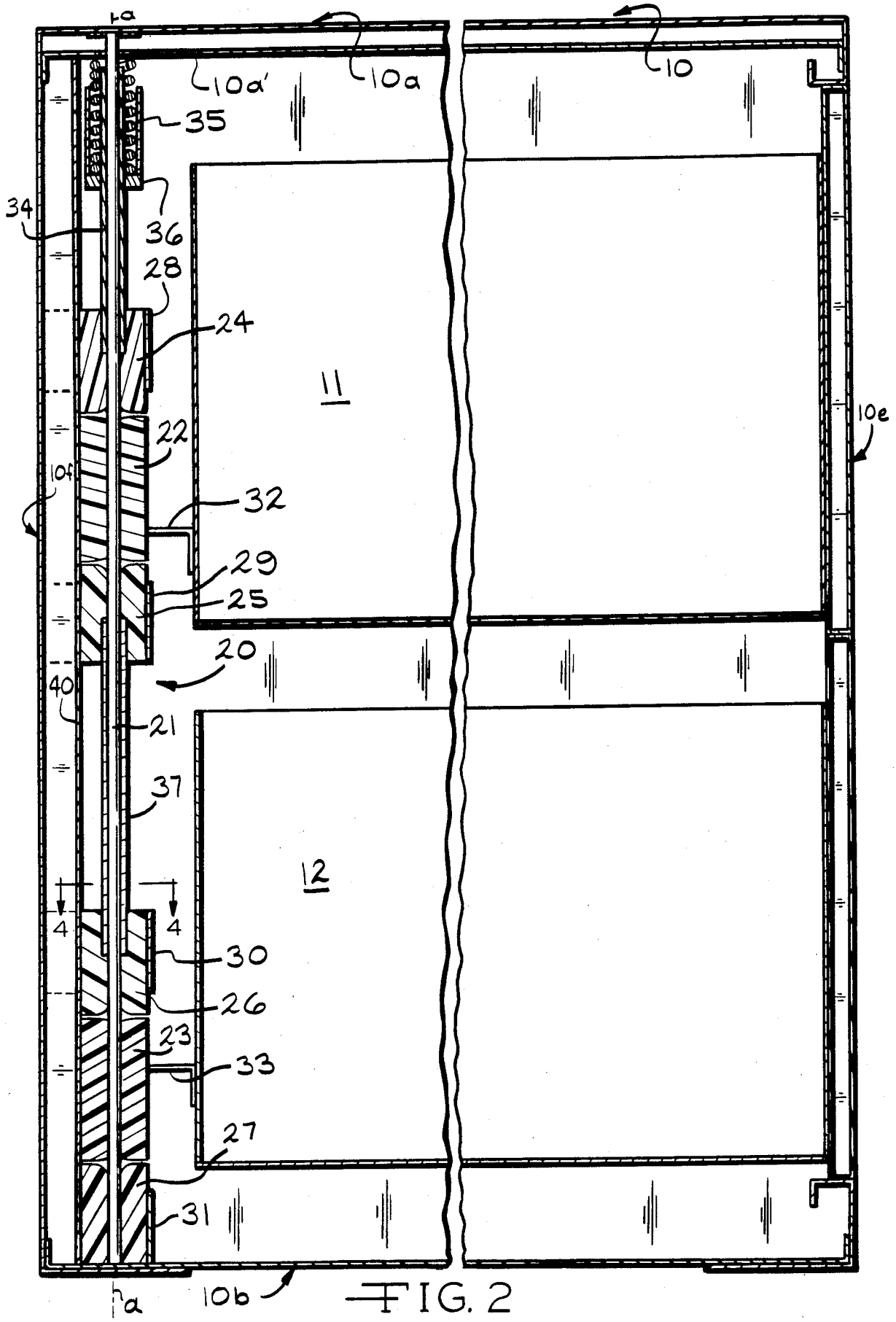

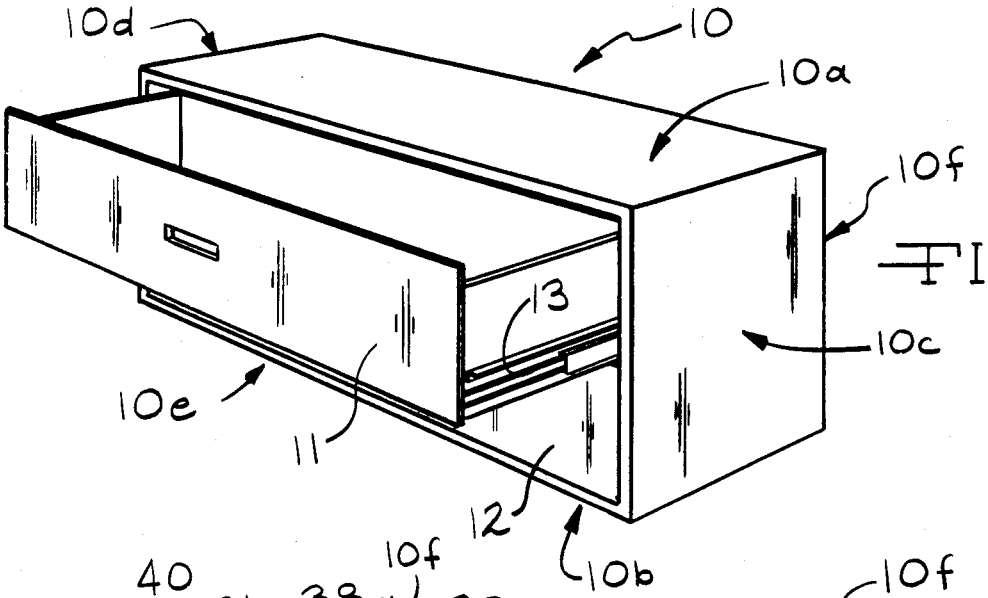
FIG. 1
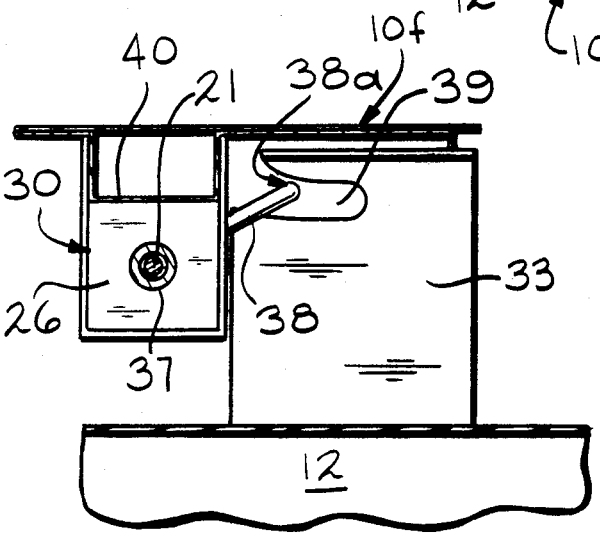
FIG. 4
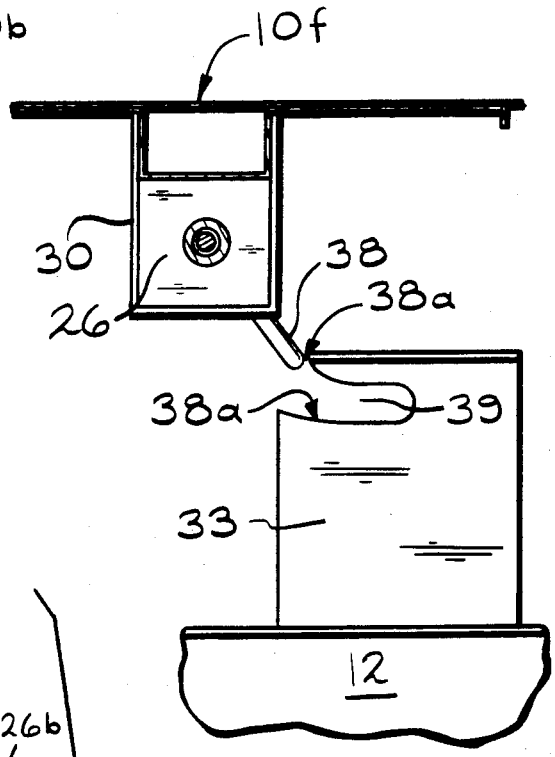
FIG. 5
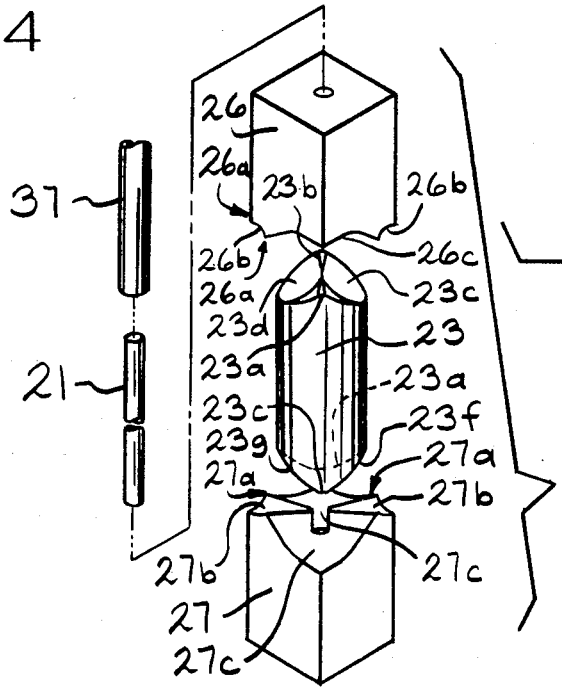

HORIZONTAL FILE DRAWER INTERLOCK ASSEMBLY

BACKGROUND OF THE INVENTION (1) Field of the Invention

The present invention relates to an improved interlock assembly for preventing more than one horizontally sliding drawer in a file cabinet from being opened at one time. In particular, the present invention relates to an interlock assembly which uses horizontally rotating cam members with opposed cam surfaces and blocks contacting the cam surfaces with mating surfaces each having lobes between valleys which engage when the cam member is rotated in one direction to provide the interlock and which disengage when the cam member is rotated in the opposite direction to release the interlock and provide the lobes in the valleys.

(2) Prior Art

U.S. Pat. No. 4,480,883 to Young shows an interlock assembly wherein cam elements rotate vertically to raise and lower vertically mounted locking bars provided in a track. The device works well; however, the interlock mechanism is quite expensive to manufacture and assemble. U.S. Pat. No. 4,298,236 to Laroche also describes cam elements which are vertically rotated to move locking bars. This apparatus is more expensive to construct. Other prior art believed to be less pertinent is described in U.S. Pat. No. 4,355,851 to Slusser are U.S. Pat. No. 3,909,090 to Breckner et al.

Objects

It is therefore an object of the present invention to provide a drawer interlock assembly which provides ease of manufacture and assembly. Further it is an object of the present invention to provide an interlock assembly which provides long and reliable service. Further it is an object of the present invention to provide an inexpensive interlock assembly. These and other objects will become increasingly apparent by reference to the following description and the drawings.

IN THE DRAWINGS

FIG. 1 is a perspective view of a cabinet 10 with two horizontally sliding drawers 11 and 12 which can utilize the interlock assembly of the present invention wherein one drawer 11 is open.

FIG. 2 is a side cross-sectional view of the cabinet 10 shown in FIG. 1 particularly showing the two horizontally sliding drawers 11 and 12 in the closed position with the interlock assembly 20 in a rest position so that either drawer 11 or 12 can be opened.

Figure 3:
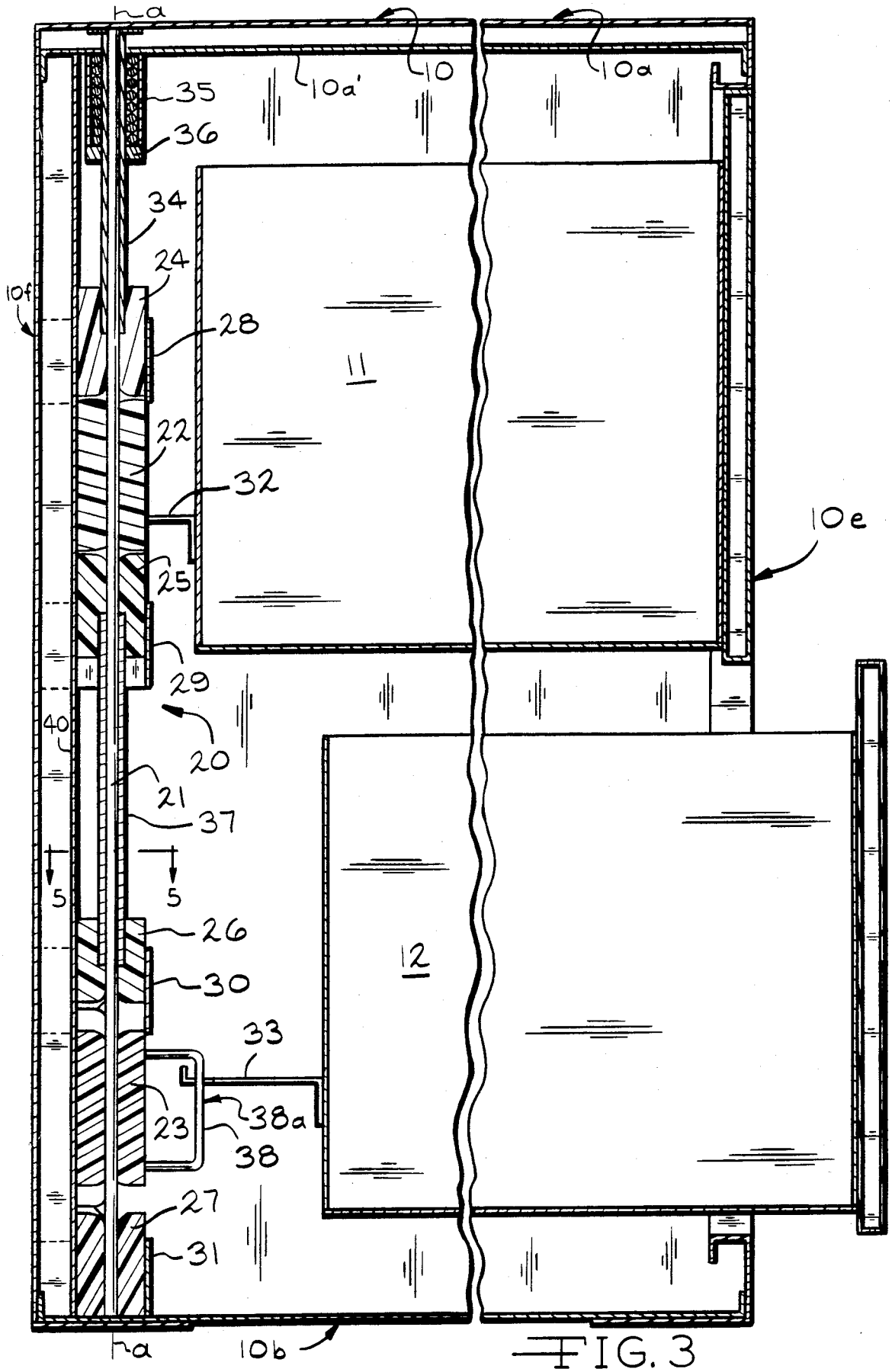

FIG. 3 is a side cross-sectional view of the cabinet 10 shown in FIG. 1 wherein one of the drawers 12 is pulled out thereby activating the interlock assembly 20 to prevent the other drawer 11 from being opened.

FIG. 4 is a plan partial sectional view along line 4—4 of FIG. 2 showing the interlock assembly 20 with the drawer 12 closed.

FIG. 5 is a plan partial sectional view along line 5—5 of FIG. 3 showing the activated interlock assembly 20 on drawer 11 which prevents the upper drawer 11 from being opened.

FIG. 6 is an exploded view of a portion of the interlock assembly 20 wherein a cam member 23 can be rotated to raise block 26 and thus the upper blocks 24 and 25 and cam member 22 shown in FIG. 2.

Figure 7:
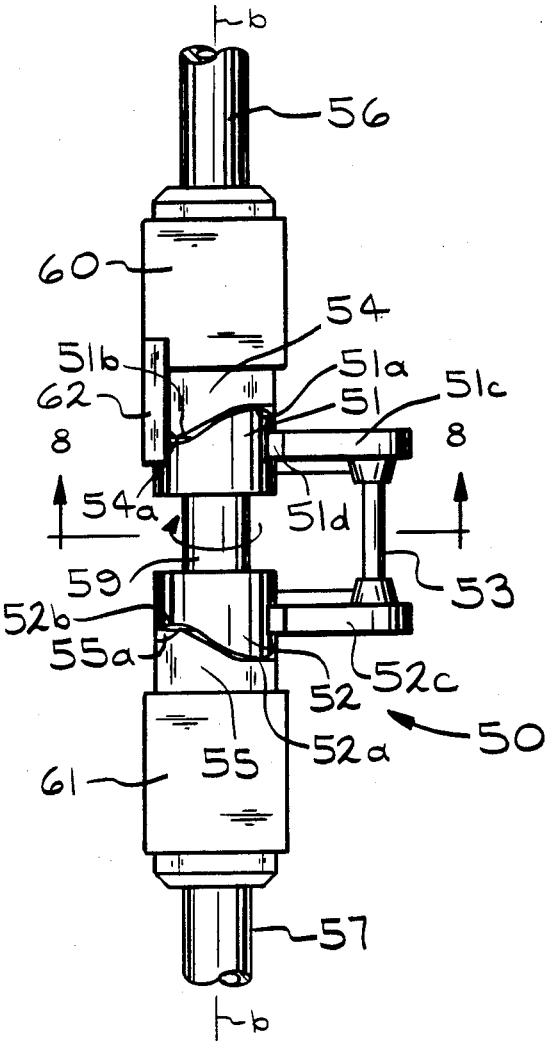

FIG. 7 is a front view showing a part of the preferred interlock assembly 50, including a rotatable cam member including cam members 51, 52, arms **51*c* and 51*d*, pin 53 and tube 59 which engages two spaced apart blocks 54 and 55 in the same manner as in FIG. 6**.

Figure 8:
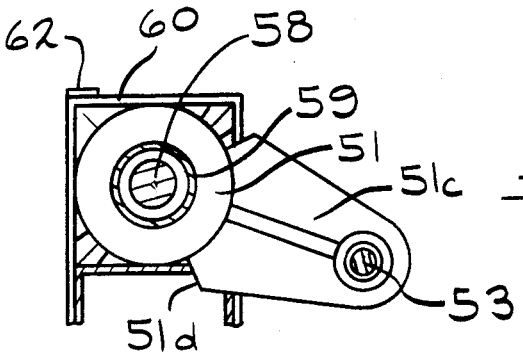

FIG. 8 is a plan cross-sectional view of the portion of the interlock assembly 50 along line 8—8 of FIG. 7.

GENERAL DESCRIPTION

The present invention relates to an improvement in a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back to close the drawer and an interlock assembly mounted inside and on the housing which engages an extension means from the drawer to prevent both drawers from being opened simultaneously wherein the interlock assembly which comprises: a rod having a longitudinal axis between two ends rigidly mounted in a parallel spaced relationship to a rear portion of each of the drawers; cam means rotatably and slideably mounted around the axis of the rod adjacent the rear portion of each of the drawers, wherein at least one end of the cam means around the axis of the rod has a sinusoidal surface such that there are lobes of the sinusoidal surface and valleys between the lobes on the surface on each cam means; block means slideably mounted on the rod at the one end of each of the cam means having the sinusoidal surface and having mating ends with second sinusoidal surfaces and lobes and valleys offset around the end of the block means when the drawers are closed so that lobes and the valleys of the cam means and block means mate together, wherein the block means extend between cam means for each drawer and between the cam means and the housing; and pivot means mounted on a side between the ends of each cam means which engages the extension means from each drawer; guide means mounted inside the housing supporting the block means for linear movement along the axis of the rod without rotational movement perpendicular to the axis of the rod upon rotation of the cam means by the pivot means and the extension means, wherein when one of the cam means is rotated by the pivot means and extension means of a first of the drawers, the lobes of the cam means and the block means are engaged and the block means between the cam means and housing moves along the axis of the rod to engage the housing, thereby preventing a second cam means from being rotated by the pivot means and extension means of a second of the drawers.

In particular the present invention relates to an improvement in a cabinet apparatus including a housing having a top wall and opposed bottom wall, two opposed side walls, a front opening and a back wall, at least two front and second drawers mounted one above the other inside the housing in the front opening so as to slide horizontally away from the front opening to open the drawer and towards the back wall to close the drawer and an interlock mechanism mounted inside and on the housing which engages an extension means from the drawer to prevent the drawers from being opened simultaneously which comprises:

a circular cross-sectioned rod having a longitudinal axis between two ends rigidly mounted vertically between the top wall and the bottom wall of the housing parallel to a rear portion of each of the drawers; cam members rotatably and slideably mounted around the axis of the rod adjacent the rear portion of each of the drawers, wherein opposite ends of each cam member have a sinusoidal surface around the axis of the rod such that there are two lobes on the sinusoidal surface opposite each other and two valleys between the lobes, wherein the lobes and valley surfaces are in identical circumferential position around the axis of the rod at each end of the cam members; block members at each of the ends of each cam member slideably mounted on the rod having ends with second sinusoidal surfaces and lobes and valleys offset by about 90° around the end of the block member so that when the drawers are closed the lobes and valleys of the cam members and blocks mate together, wherein the block members extend between each drawer and between the cam members and the housing; pivot members between the ends and on a side of each cam member which engage the extension means from each drawer; and guide brackets mounted on the housing supporting the block members from linear movement along the axis of the rod without rotational movement perpendicular to the axis of the rod upon rotation of the cam member by the pivot member and the extension means, wherein when one of the cam members is rotated on the rod by the pivot means and the extension means of the first of the drawers the lobes of the cam members and the block means are engaged, and a tubular extension mounted on one of the block members moves along the axis of the rod to engage the housing, thereby preventing a second cam member from being rotated by the pivot member and extension means of the second of the drawers.

The train of block means and cam means forming the interlock assembly thus are slideably mounted for movement along an axis of the rod so that block means of the assembly engages the housing by means of rotation of one cam member by an extension means engaging a pivot member on the cam member. The result is that a second cam member is prevented from rotation by a second extension means engaging a second pivot means since the train can not move any further on the rod. As will be seen, the interlock assembly is very inexpensive to construct and assemble and provides safe, trouble free service.

SPECIFIC DESCRIPTION

FIG. 1 shows a file cabinet 10 providing a housing for two drawers 11 and 12 which slide in and out on sliders 13 (one shown) on each side of the drawers 11 and 12. The cabinet 10 includes a top wall 10*a*, bottom wall 10*b*, opposed side walls 10*c* and 10*d* and a front wall 10*e* and a back wall 10*f* which serve as reference points in the following description.

A vertically oriented interlock assembly 20 is shown in position in the cabinet 10 in FIGS. 2 and 3. The assembly 20 is preferably positioned about midway on the back wall 10*f* between side walls 10*c* and 10*d* of the cabinet 10. A rod 21 is vertically oriented along axis a—a and securely mounted between the top wall 10*a* and bottom wall 10*b* of the cabinet 10 adjacent to and in closely spaced relationship to the drawers 11 and 12. Mounted around the rod 21 are vertically slideable and horizontally rotatable cam members 22 and 23. On either side of and in contact with the cam members 22 and 23 are mounted cam blocks 24, 25, 26 and 27. The cam blocks 24, 25, 26 and 27 are slideable vertically and secured to the back wall 10*f* of the cabinet 10 by means of brackets 28, 29, 30 and 31 which are joined together as a unit by plate 40. Extending from the back of each drawer 11 and 12 are extensions 32 and 33 which cooperate with the cam members 22 and 23 as hereinafter described in detail.

A tubular member 34 extends from block 21 to a point in spaced relationship from the top wall 10*a* of the cabinet 10 as shown in FIG. 2 with the drawers 11 and 12 closed. A coil spring 35 is mounted on an end of the rod 21 adjacent the inner top wall 10*a'* of the cabinet 10 in a cup 36 secured to tube 34. The spring 35 urges the cup 36, tubular member 34, blocks 24, 25, 26 and 27 and cam members 22 and 23 downward to urge the interlock assembly 20 into a closed drawer position. The tubular member 34 and/or cup 36 engages the top wall 10*a* or inner wall 10*a'* when a drawer 11 or 12 is opened as shown in FIG. 3. A second tubular member 37 spaces the blocks 25 and 26 which can be interconnected in any convenient manner for vertical sliding movement. As shown, drawers 11 and 12 open to the right and are otherwise conventionally constructed as is the cabinet 10.

FIG. 3 shows a U-shaped pivot member 38 which is rotated clockwise by extension 33 by pulling drawer 12 (or 11) open. FIGS. 4 to 6 show the rotation of the pivot member 38 when the drawer 12 opens. The pivot member 38 rides on vertical section 38*a* in an arcuately shaped slot 39 on cam surface 39*a*. The blocks 26 and 27 have lobes 27*a* with indentations 27*b* and valleys 27*c* between the lobes 27*a*. The block 26 has corresponding lobes 26*a*, indentations 26*b* and valleys 26*c*. Both ends of cam 23 have lobes 23*a* and 23*b* and valleys 23*c* and 23*d*. The blocks 24 and 25 and cam 22 are identically constructed to blocks 26 and 27 and cam member 23. The cam members 22 and 23 essentially have a sinusoidal surface or face at each end as do the blocks 24, 25, 26 and 27 which engages the cam members 22 and 23. In the closed drawer position, the lobes 23*a* and 23*b* of cam 23 are in valleys 26*c* and 27*c* of blocks 26 and 27 and are about 90° around the axis of the rod 21.

As can be seen from FIG. 3, when the cam member 23 is rotated by extension 33 engaging pivot member 38, the lobes 23*a* and 23*b* engage detents 26*b* of lobes 26*a* on block 26 and lobes 23*c* and 23*d* engage detents 27*b* in lobes 27*a* of block 27. Thus the train of blocks 24, 25 and 26 tubular members 34 and 37 and cam member 22 are moved upward so that the cup 36 engages the inner housing wall 10*a'* to provide a stop. The spring 35 is compressed by the upward movement of the train. When the drawer 12 is closed, the cam member 23 is rotated by pivot member 38 and the train moves down so that the lobes 23*a*, 23*b*, 23*c* and 23*d* are in the valleys 26*c* and 27*c* of the blocks 26 and 27, thus allowing another drawer 11 or the same drawer 12 to be reopened. Preferably the pivot member 38 moves in an arc perpendicular to the axis of the rod of about 85°. The lobes 23*a*, 23*b*, 23*c* and 23*d* do not rest completely in the valleys 26*c* and 27*c* so that there is some tension between the cam member 23 and the blocks 26 and 27 thereby preventing rebound. The 5° from 90° (i.e. 85°) allows the tension.

FIGS. 7 and 8 show an improved moldable interlock assembly 50 wherein cam surfaces are provided by dual spaced apart cams 51 and 52 with lobes 51*a* and 52*a* and valleys 51*b* and 52*b*. Integral radially extending arms 51*c* and 52*c* from the axis b—b of rod 58 along with pin 53 provide a pivot means. Cams 54 and 55 are spaced apart by tube 59 to provide the cam means as in FIG. 6.

Tubular members 56 and 57 fit around the rod 58 and provide part of the block means as shown in FIGS. 2 and 3. Brackets 60 and 61 are mounted to the back wall 10*f* of the cabinet 10 in the manner shown in FIGS. 2 and 3. An extension 62 engages plate 51*d* on arm 51*c* to prevent the arm 51*c* from over rotating in the clockwise direction so that lobes 51*a* and 52*a* engage detents 54*a* and 55*a* in blocks 54 and 55. In operation, the cams 51 and 52 and blocks 54 and 55 act to provide an interlock in the same manner as the cam member 22 and 23 and blocks 24, 25, 26 and 27 shown in FIGS. 2 and 3.

It will be appreciated that the rod member could be positioned at an angle to the vertical between the drawers where the drawers are one above the other. The file drawers can be side by side rather than one above the other with the interlock assembly in a horizontal position. The vertical positioning is preferred for ease of installation and operation of the interlock assembly 20. The coiled spring can also be at the bottom or side wall of the housing. The cam members and blocks are preferably made of a rigid plastic material, preferably nylon or acetyl resin and can be molded in the configurations as shown in FIGS. 7 and 8. A sliding pin on the blocks mounted in slots in the bracket (not shown) can be used to prevent rotation of the blocks perpendicular to the axis of the rod. All such variations will be obvious to those skilled in the art and it is intended that the invention be limited only by the hereinafter appended claims.

I claim:

1. In a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back to close the drawer and an interlock assembly mounted inside and on the housing which engages an extension means from the drawer to prevent both drawers from being opened simultaneously the improvement in the interlock assembly which comprises:

(a) a rod having a longitudinal axis between two ends rigidly mounted in a parallel spaced relationship to a rear portion of each of the drawers;

(b) cam means rotatably and slideably mounted around the axis of the rod adjacent the rear portion of each of the drawers, wherein at least one end of the cam means around the axis of the rod has a sinusoidal surface such that there are lobes of the sinusoidal surface and valleys between the lobes on the surface on each cam means;

(c) block means slideably mounted on the rod at the one end of each of the cam means having the sinusoidal surface and having mating ends with second sinusoidal surfaces with lobes and valleys offset around the end of the block means when the drawers are closed so that the lobes and the valleys of the cam means and blocks means mate together;

(d) pivot means mounted on a side between the ends of each cam means which engages the extension means from each drawer; and (e) guide means mounted inside the housing supporting the block means for linear movement along the axis of the rod without rotational movement perpendicular to the axis of the rod upon rotation of the cam means by the pivot means and the extension means, wherein the guide means support the interlock assembly to prevent movement of the rod, cam means and block means perpendicular to the longitudinal axis of the rod and wherein when one of the cam means is rotated by the pivot means and extension means of a first of the drawers, the lobes of the cam means and the block means are engaged and the block means between the cam means and housing moves along the axis of the rod to engage the housing, thereby preventing a second cam means from being rotated by the pivot means and extension means of a second of the drawers.

2. In a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back to close the drawer and an interlock assembly mounted inside and on the housing which engages an extension means from the drawer to prevent both drawers from being opened simultaneously the improvement in the interlock assembly which comprises:

(a) a rod having a longitudinal axis between two ends rigidly mounted in a parallel spaced relationship to a rear portion of each of the drawers;

(b) cam members rotatably and slideably mounted around the axis of the rod adjacent the rear portion of each of the drawers, wherein opposite ends of the cam member have a sinusoidal surface around the axis of the rod such that there are lobes of the sinusoidal surface and valleys between the lobes on the surface at each end of each cam member, wherein the sinusoidal surfaces at each end of the cam members are in an identical circumferential position around the axis of the rod;

(c) block means slideably mounted on the rod at each of the ends of each cam member having ends with second sinusoidal surfaces with lobes and valleys offset around the end of the block means when the drawers are closed so that the lobes and valleys of the cam members and block means mate together, wherein the block means extend between cam members for each drawer and between the cam member and the housing;

(d) pivot means mounted on a side and between the ends of each cam member which engages the extension means from each drawer; and (e) guide means mounted inside the housing supporting the block means for linear movement along the axis of the rod without rotational movement perpendicular to the axis of the rod upon rotation of the cam member by the pivot means and the extension means, wherein the guide means support the interlock assembly to prevent movement of the rod, cam means and block means perpendicular to the longitudinal axis of the rod and wherein when one of the cam members is rotated by the pivot means and extension means of a first of the drawers the lobes of the cam means and the block means are engaged and the block means between the cam means and housing moves along the axis of the rod to engage a portion of the housing, thereby preventing a second cam member from being rotated by the pivot means and extension means of a second of the drawers.

3. The apparatus of claim 2 wherein a spring means is provided around the rod so as to urge the block means and cam members together in a closed drawer position.

4. The apparatus of claim 2 wherein the rod is vertically oriented between the top and the bottom of the housing.

5. The apparatus of claim 2 wherein the block means includes a tubular member mounted along the axis of the rod between square cross-sectioned blocks positioned between the drawers.

6. The apparatus of claim 2 wherein the rod is mounted with the axis vertically oriented with the ends of the rod mounted on and between the top wall and the bottom wall of the housing; and wherein a coil spring means is provided around the end of the rod at the top wall of the housing engaging the block means and the housing so as to urge the interlock assembly into a closed drawer position.

7. The apparatus of claim 2 wherein one of the block means adjacent the top wall of the housing includes a block mounting a projection towards the top wall of the housing such that there is a space between the projection and the housing when the drawers are closed and such that the projection engages the top wall of the housing when one of the drawers is open so that the interlock assembly is raised by one cam member, thereby preventing the opening of another drawer.

8. The apparatus of claim 7 wherein a cup shaped member is part of the projection which supports a coil spring means around the end of the rod between the top wall of the housing and the cup shaped member so as to urge the interlock assembly into a closed drawer position and wherein the cup shaped member engages the top wall of the housing to provide the interlock.

9. The apparatus of claim 2 wherein the cam member includes a tubular member slideably mounted on the rod between two spaced apart cylindrically cross-sectioned cams having the sinusoidal surfaces and wherein the pivot means includes arms from each of the cams perpendicular to the axis of the rod with a pin between the arms which can engage the extension means.

10. The apparatus of claim 9 wherein the cams and arms are integral.

11. The apparatus of claim 10 wherein the arms have side plates which engage a portion of the guide means to limit movement of the arms to a selected arc around the axis of the rod.

12. The apparatus of claim 2 wherein the cam members and block means are composed of a rigid plastic material.

13. The apparatus of claim 2 wherein the rigid plastic material is a nylon or acetyl resin.

14. In a cabinet apparatus including a housing having a top wall and opposed bottom wall, two opposed side walls, a front opening and a back wall, at least two front and second drawers mounted one above the other inside the housing in the front opening so as to slide horizontally away from the front opening to open the drawer and towards the back wall to close the drawer and an interlock mechanism mounted inside and on the housing which engages an extension means from the drawer to prevent the drawers from being opened simultaneously the improvement which comprises:

(a) a circular cross-sectioned rod having a longitudinal axis between two ends rigidly mounted vertically between the top wall and the bottom wall of the housing parallel to a rear portion of each of the drawers;

(b) cam members rotatably and slideably mounted around the axis of the rod adjacent the rear portion of each of the drawers, wherein opposite ends of each cam member have a sinusoidal surface around the axis of the rod such that there are lobes on the sinusoidal surface opposite each other and valleys between the lobes, wherein the lobes and valley surfaces are in identical circumferential position around the axis of the rod at each end of the cam members;

(c) block members at each of the ends of each cam member slideably mounted on the rod having ends with second sinusoidal surfaces and lobes and valleys offset around the end of the block member so that when the drawers are closed the lobes and valleys of the cam members and blocks mate together, wherein the block members extend between spaced apart cam members and between the cam members and the housing;

(d) pivot members between the ends and on a side of each cam member which engage the extension means from each drawer; and (e) guide brackets mounted on the housing supporting the block members for linear movement along the axis of the rod without rotational movement perpendicular to the axis of the rod upon rotation of the cam member by the pivot member and the extension means, wherein the guide brackets support interlock assembly to prevent movement of the rod, cam members and block members perpendicular to the longitudinal axis of the rod and wherein when one of the cam members is rotated on the rod by the pivot means and the extension means of the first of the drawers, the lobes of the cam members and the block members are engaged, and an extension mounted on one of the block members moves along the axis of the rod to engage a portion of the housing, thereby preventing a second cam member from being rotated by the pivot member and extension means of the second of the drawers.

15. The apparatus of claim 14 wherein a coil spring is provided around the rod on the extension and against the housing so as to urge the block members and cam members to a closed drawer position.

16. The apparatus of claim 15 wherein a cup shaped member is mounted on the extension which supports the coil spring against the housing and which engages the top wall of the housing to provide the interlock.

17. The apparatus of claim 14 wherein the block members include spaced apart blocks connected by a tube slideably mounted on the rod between the cam members.

18. The apparatus of claim 14 wherein the cam members and block members are composed of a rigid plastic material.

19. The apparatus of claim 14 wherein each cam member includes a tubular member around the rod between spaced apart circularly cross-sectioned cams having the sinusoidal surfaces and wherein the pivot member includes arms from each of the cams perpendicular to the axis with a pin between the arms which can engage the extension means.

20. The apparatus of claim 19 wherein the cams and arms are integral.

21. The apparatus of claim 20 wherein the cams and block members are composed of a rigid plastic material.

22. The apparatus of claim 19 wherein the arms have side plates which engage a portion of the guide bracket to limit movement of the arms to a preselected arc perpendicular to the axis of the rod.

23. The apparatus of claim 14 wherein the lobes of the sinusoidal surfaces of the block members or cam members have recesses which act as detents to hold the lobes in engagement when the drawers are open and which release the lobes upon closing of the drawer.

24. In a cabinet apparatus including a housing having a top wall and opposed bottom wall, two opposed side walls, a front wall and a back wall, at least two drawers mounted inside the housing through the front wall so as to slide horizontally away from the front wall to open the drawer and towards the back to close the drawer and an interlock assembly mounted inside and on the housing which engages an extension means from the drawer to prevent both drawers from being opened simultaneously the improvement in the interlock assembly which comprises:

(a) a rod having a longitudinal axis between two ends ridigly mounted in a parallel spaced relationship to a rear portion of each of the drawers;

(b) cam means rotatably and slideably mounted around the axis of the rod adjacent the rear portion of each of the drawers, wherein at least one end of the cam means around the axis of the rod has a first sinusoidal surface;

(c) block means slideably mounted on the rod at the one end of each of the cam means with a second sinusoidal surface offset around the axis of the rod from the first sinusoidal surface of the cam member when the drawers are closed so that the first and second sinusoidal surfaces of the cam means and block means mate together, wherein the block means extend between cam means for each drawer and between the cam means and the housing;

(d) pivot means mounted on a side between the ends of each cam means which engages the extension means from each drawer; and (e) guide means mounted inside the housing supporting the block means for linear movement along the axis of the rod without rotational movement perpendicular to the axis of the rod upon rotation of the cam means by the pivot means and the extension means, wherein the guide means support the interlock assembly to prevent movement of the rod, cam means and block means perpendicular to the longitudinal axis of the rod and wherein when one of the cam means is rotated by the pivot means and extension means of a first of the drawers, the first and second sinusoidal surfaces of the cam means and the block means no longer mate together and the block means between the cam means and housing moves along the axis of the rod to engage the housing, thereby preventing a second cam means from being rotated by the pivot means and extension means of a second of the drawers.

* * * * *